US011045741B2

(12) United States Patent
Hsu

(10) Patent No.: US 11,045,741 B2
(45) Date of Patent: Jun. 29, 2021

(54) HURDLE STRUCTURE

(71) Applicant: Chi-Kun Hsu, Lukang Township (TW)

(72) Inventor: Chi-Kun Hsu, Lukang Township (TW)

( * ) Notice: Subject to any disclaimer, the term of this patent is extended or adjusted under 35 U.S.C. 154(b) by 10 days.

(21) Appl. No.: 16/522,763

(22) Filed: Jul. 26, 2019

(65) Prior Publication Data

US 2020/0078700 A1 Mar. 12, 2020

(30) Foreign Application Priority Data

Sep. 12, 2018 (TW) ..... 107212479

(51) Int. Cl.
*A63K 3/04* (2006.01)

(52) U.S. Cl.
CPC ..... *A63K 3/043* (2013.01)

(58) Field of Classification Search
CPC ..... A63K 3/043; A63B 63/004; A63B 1/00; A63B 1/01; A63B 1/02; A63B 1/03; A63B 1/04; A63B 3/00; Y10T 403/32327; Y10T 403/32336; Y10T 403/32368
See application file for complete search history.

(56) References Cited

U.S. PATENT DOCUMENTS 5,263,507 A * 11/1993 Chuang ..... E04H 15/46 135/140
6,592,500 B1 * 7/2003 McBride ..... A63B 21/0004 482/140
2012/0184399 A1 * 7/2012 Reeves ..... F16B 7/0413 473/478

* cited by examiner

*Primary Examiner* — Nyca T Nguyen
*Assistant Examiner* — Andrew M Kobylarz
(74) *Attorney, Agent, or Firm* — Alan D. Kamrath; Karin L. Williams; Mayer & Williams PC

(57) ABSTRACT

A hurdle structure includes a transverse bar, two upright poles, two support rods, and a plurality of hinge mechanisms. Each of the hinge mechanisms is mounted between the transverse bar and each of the two upright poles, and between each of the two upright poles and each of the two support rods. Each of the hinge mechanisms includes a first pivot member, and a second pivot member pivotally connected with the first pivot member. Each of the hinge mechanisms further includes an adjusting unit mounted between the first pivot member and the second pivot member. The adjusting unit includes a locking member and a positioning member. The locking member is provided with a plurality of grooves. The positioning member is provided with a projection positioned in one of the grooves of the locking member.

10 Claims, 9 Drawing Sheets

HURDLE STRUCTURE

BACKGROUND OF THE INVENTION

1. Field of the Invention

The present invention relates to a hurdle and, more particularly, to a hurdle structure for track and field sports.

2. Description of the Related Art

A conventional hurdle structure comprises two L-shaped racks, and a transverse bar mounted between the two L-shaped racks. Each of the two L-shaped racks includes a vertical section having an upper end secured to the transverse bar, and a horizontal section secured to the lower end of the vertical section. Thus, the user employs the hurdle structure for training purposes. However, the conventional hurdle structure has a fixed height that cannot be adjusted according to users of different height, so that the users of different height have to choose hurdle structures of different sizes, thereby causing inconvenience to the users.

BRIEF SUMMARY OF THE INVENTION

The primary objective of the present invention is to provide a hurdle structure with an adjustable height.

In accordance with one embodiment the present invention, there is provided a hurdle structure comprising a transverse bar, two upright poles, two support rods, and a plurality of hinge mechanisms. The transverse bar has two ends. Each of the two upright poles has an upper end. Each of the hinge mechanisms is mounted between the transverse bar and each of the two upright poles and includes a first pivot member, and a second pivot member pivotally connected with the first pivot member. The first pivot member of each of the hinge mechanisms is provided with a first mounting portion secured on one of the two ends of the transverse bar. The second pivot member of each of the hinge mechanisms is provided with a second mounting portion secured on the upper end of one of the two upright poles. Each of the hinge mechanisms further includes an adjusting unit mounted between the first pivot member and the second pivot member. The adjusting unit of each of the hinge mechanisms includes a locking member and a positioning member. The locking member of each of the hinge mechanisms is provided with a plurality of grooves. The positioning member of each of the hinge mechanisms is provided with a projection positioned in one of the grooves of the locking member, such that each of the two upright poles is locked with the transverse bar, with a predetermined angle defined between each of the two upright poles and the transverse bar.

In accordance with another embodiment the present invention, there is provided a hurdle structure comprising a transverse bar, two upright poles, two support rods, and a plurality of hinge mechanisms. The transverse bar has two ends. Each of the two upright poles has a lower end. Each of the two support rods has an end portion. Each of the hinge mechanisms is mounted between each of the two upright poles and each of the two support rods and includes a first pivot member, and a second pivot member pivotally connected with the first pivot member. The first pivot member of each of the hinge mechanisms is provided with a first mounting portion secured on the lower end of one of the two upright poles. The second pivot member of each of the hinge mechanisms is provided with a second mounting portion secured on the end portion of one of the two support rods. Each of the hinge mechanisms further includes an adjusting unit mounted between the first pivot member and the second pivot member. The adjusting unit of each of the hinge mechanisms includes a locking member and a positioning member. The locking member of each of the hinge mechanisms is provided with a plurality of grooves. The positioning member of each of the hinge mechanisms is provided with a projection positioned in one of the grooves of the locking member, such that each of the two upright poles is locked with each of the two support rods, with a predetermined angle defined between each of the two upright poles and each of the two support rods.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
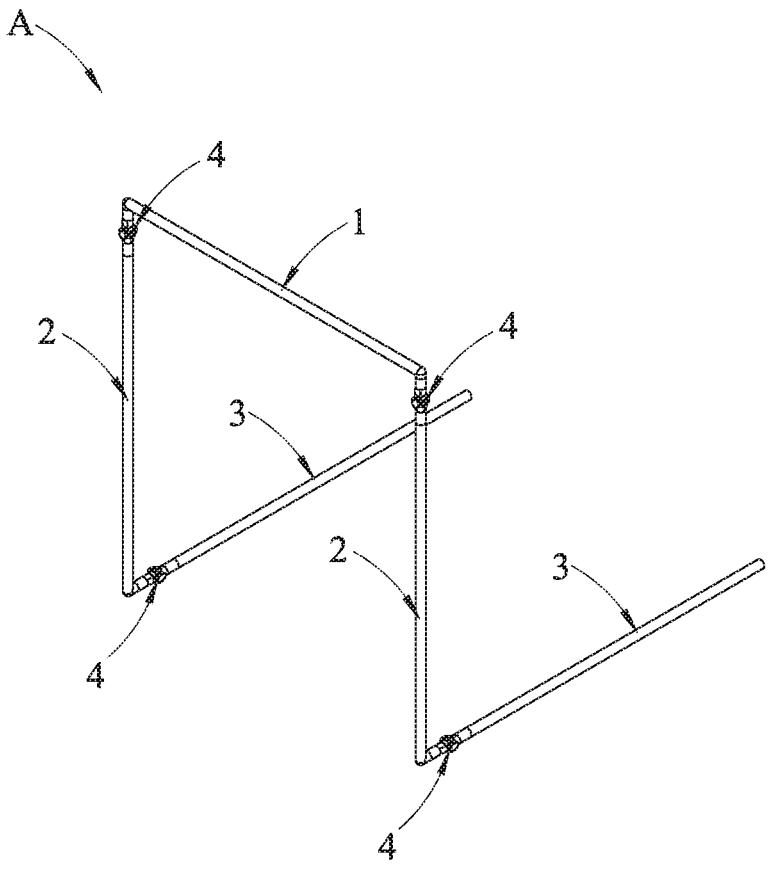
FIG. 1 is a perspective view of a hurdle structure in accordance with the preferred embodiment of the present invention.
Figure 2:
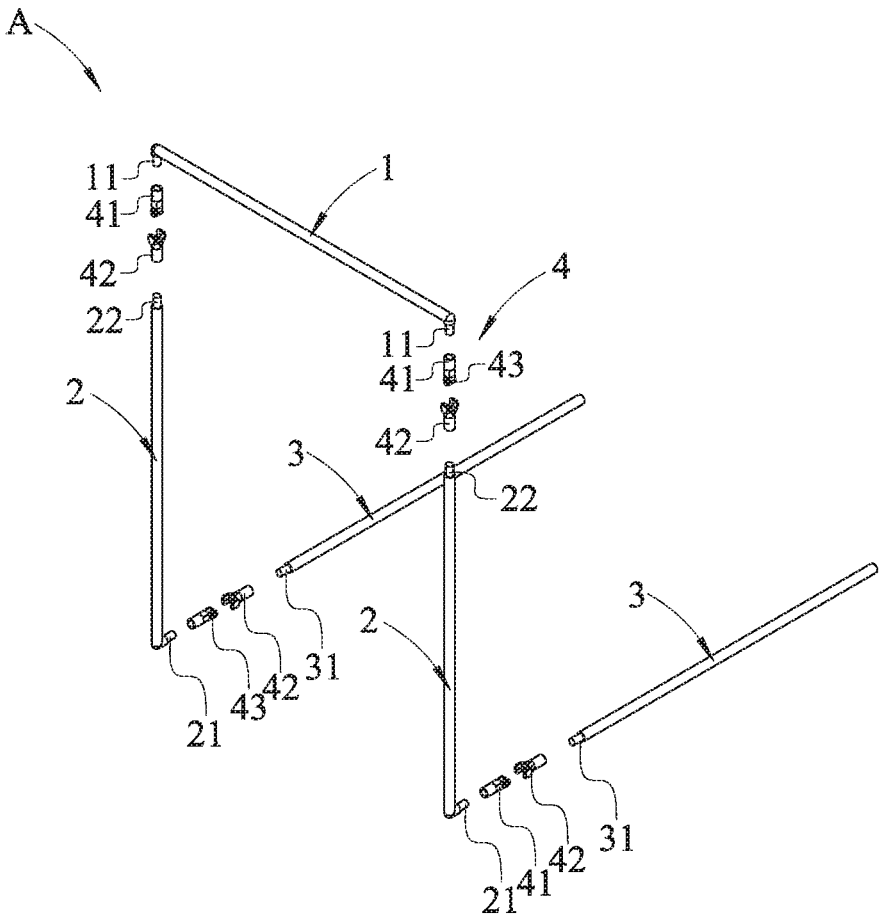
FIG. 2 is an exploded perspective view of the hurdle structure as shown in FIG. 1.

Referring to the drawings and initially to FIGS. 1-8, a hurdle structure A in accordance with the preferred embodiment of the present invention comprises a transverse bar 1, two upright poles 2, two support rods 3, and a plurality of hinge mechanisms 4.

The transverse bar 1 has two ends 11. Each of the two upright poles 2 has an upper end 22. Each of the hinge mechanisms 4 is mounted between the transverse bar 1 and each of the two upright poles 2 and includes a first pivot member 41, and a second pivot member 42 pivotally connected with the first pivot member 41. The first pivot member 41 of each of the hinge mechanisms 4 is provided with a first mounting portion 411 secured on one of the two ends 11 of the transverse bar 1. The second pivot member 42 of each of the hinge mechanisms 4 is provided with a second mounting portion 421 secured on the upper end 22 of one of the two upright poles 2.

Each of the hinge mechanisms 4 further includes an adjusting unit 43 mounted between the first pivot member 41 and the second pivot member 42. The adjusting unit 43 of each of the hinge mechanisms 4 includes a locking member 431 and a positioning member 432. The locking member 431 of each of the hinge mechanisms 4 is provided with a plurality of grooves 4311. The positioning member 432 of each of the hinge mechanisms 4 is provided with a projection 4321 positioned in one of the grooves 4311 of the locking member 431, such that each of the two upright poles 2 is locked with the transverse bar 1, with a predetermined angle defined between each of the two upright poles 2 and the transverse bar 1.

Figure 6:
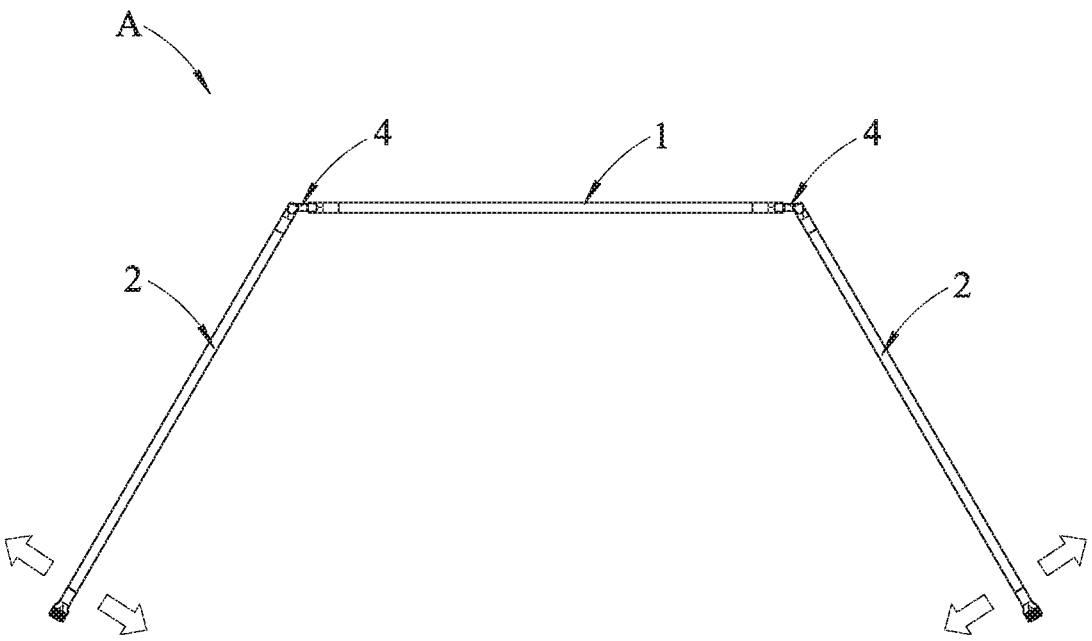
FIG. 6 is a planar operational view showing an angle adjustment between the transverse bar and each of the two upright poles.

In adjustment, when the first pivot member 41 and the second pivot member 42 are driven by an external force to rotate relative to each other, the projection 4321 of the positioning member 432 is detached from one of the grooves 4311 of the locking member 431 and is received in another one of the grooves 4311 of the locking member 431. Thus, the first pivot member 41 and the second pivot member 42 are rotated relative to each other to adjust the angle between the transverse bar 1 and each of the two upright poles 2 as shown in FIG. 6 or to fold the transverse bar 1 and each of the two upright poles 2.

In the preferred embodiment of the present invention, each of the hinge mechanisms 4 is also mounted between each of the two upright poles 2 and each of the two support rods 3. Alternatively, each of the two upright poles 2 and each of the two support rods 3 are formed integrally.

In the preferred embodiment of the present invention, the projection 4321 of the positioning member 432 is a circular rod, and each of the grooves 4311 of the locking member 431 has a shape corresponding to that of the projection 4321, such that the projection 4321 of the positioning member 432 is locked and secured in one of the grooves 4311 of the locking member 431.

In the preferred embodiment of the present invention, each of the grooves 4311 of the locking member 431 has two sides each provided with an arcuate face 4312 to guide movement of the projection 4321 of the positioning member 432 along each of the grooves 4311 of the locking member 431.

Figure 3:
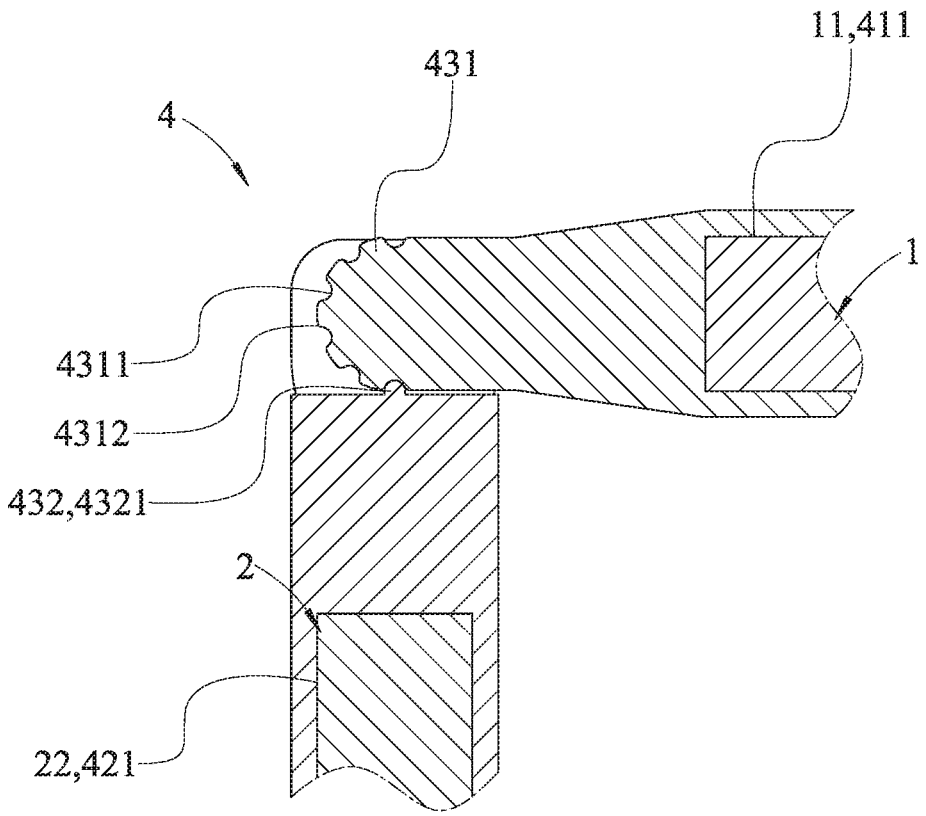
FIG. 3 is a locally enlarged cross-sectional view of the hurdle structure in accordance with another preferred embodiment of the present invention.
Figure 4:
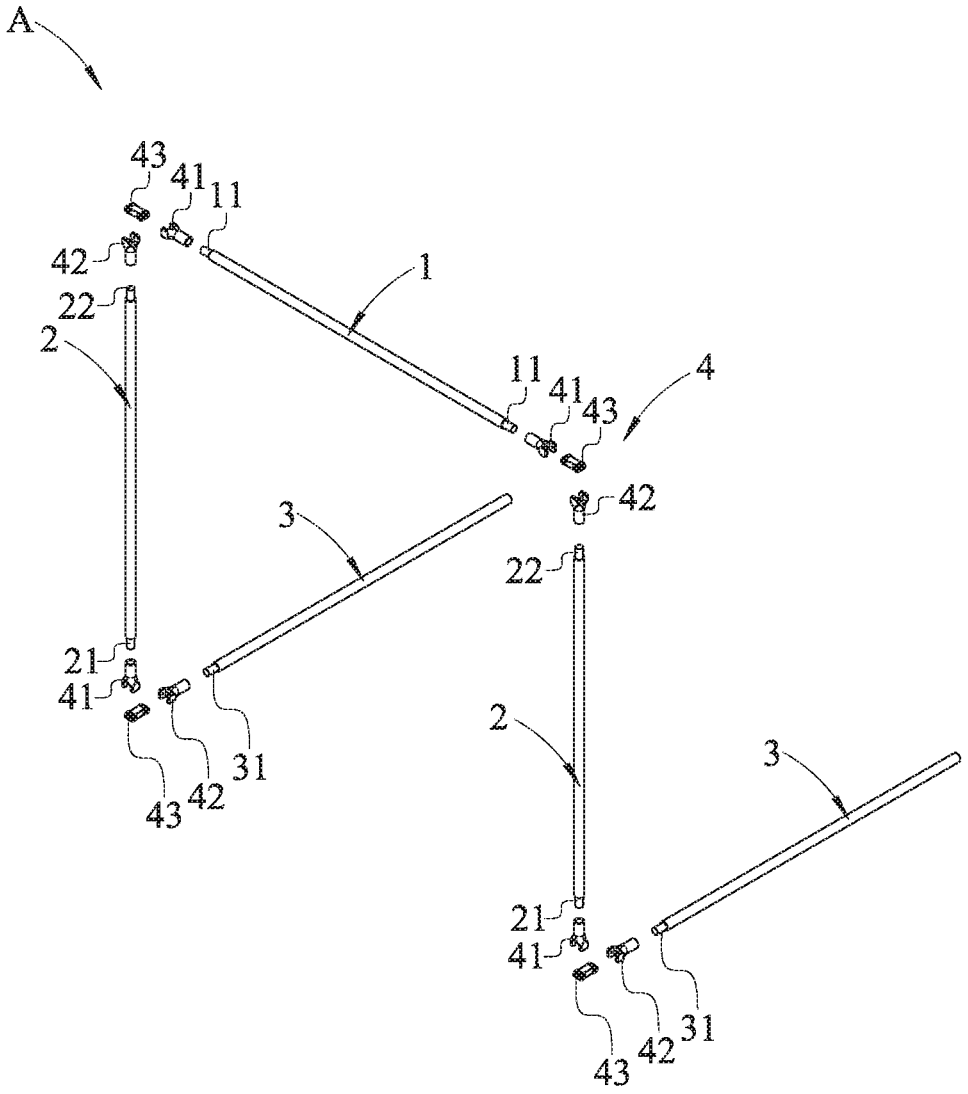
FIG. 4 is an exploded perspective view of the hurdle structure in accordance with another preferred embodiment of the present invention.

As shown in FIG. 3, the locking member 431 of each of the hinge mechanisms 4 is formed on the first pivot member 41, and the positioning member 432 of each of the hinge mechanisms 4 is formed on the second pivot member 42.

Figure 5:
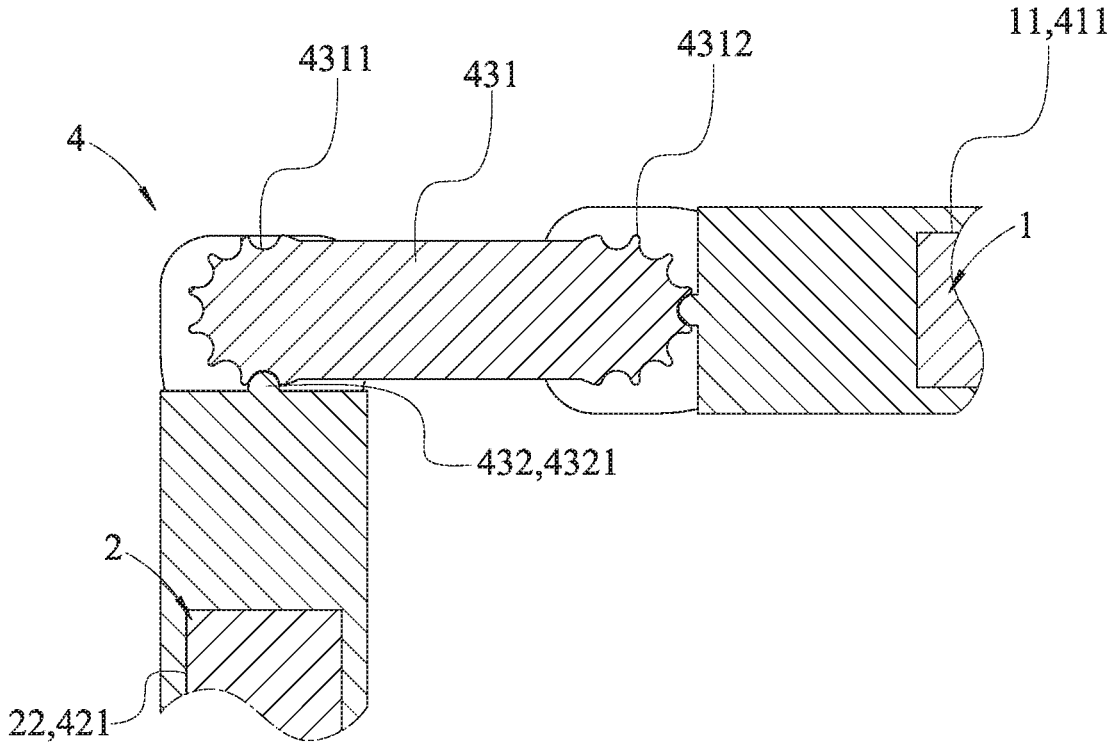
FIG. 5 is a locally enlarged cross-sectional view of the hurdle structure in accordance with a further preferred embodiment of the present invention.

As shown in FIG. 5, the locking member 431 of each of the hinge mechanisms 4 is mounted between the first pivot member 41 and the second pivot member 42, and the positioning member 432 of each of the hinge mechanisms 4 is formed on the first pivot member 41 and the second pivot member 42. Preferably, the locking member 431 of each of the hinge mechanisms 4 has two ends each provided with a plurality of grooves 4311.

The hurdle structure A in accordance with a second preferred embodiment of the present invention comprises a transverse bar 1, two upright poles 2, two support rods 3, and a plurality of hinge mechanisms 4.

The transverse bar 1 has two ends 11. Each of the two upright poles 2 has a lower end 21. Each of the two support rods 3 has an end portion 31. Each of the hinge mechanisms 4 is mounted between each of the two upright poles 2 and each of the two support rods 3 and includes a first pivot member 41, and a second pivot member 42 pivotally connected with the first pivot member 41. The first pivot member 41 of each of the hinge mechanisms 4 is provided with a first mounting portion 411 secured on the lower end 21 of one of the two upright poles 2. The second pivot member 42 of each of the hinge mechanisms 4 is provided with a second mounting portion 421 secured on the end portion 31 of one of the two support rods 3.

Each of the hinge mechanisms 4 further includes an adjusting unit 43 mounted between the first pivot member 41 and the second pivot member 42. The adjusting unit 43 of each of the hinge mechanisms 4 includes a locking member 431 and a positioning member 432. The locking member 431 of each of the hinge mechanisms 4 is provided with a plurality of grooves 4311. The positioning member 432 of each of the hinge mechanisms 4 is provided with a projection 4321 positioned in one of the grooves 4311 of the locking member 431, such that each of the two upright poles 2 is locked with each of the two support rods 3, with a predetermined angle defined between each of the two upright poles 2 and each of the two support rods 3.

Figure 7:
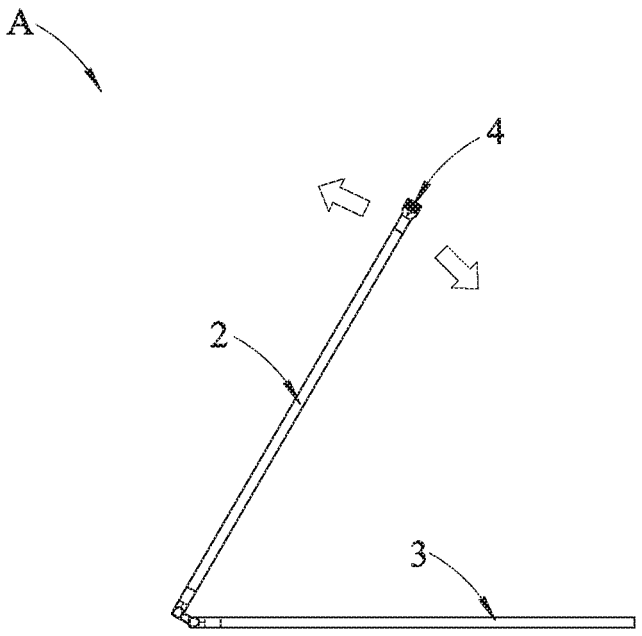
FIG. 7 is a planar operational view showing an angle adjustment between each of the two upright poles and each of the two support rods.
Figure 8:
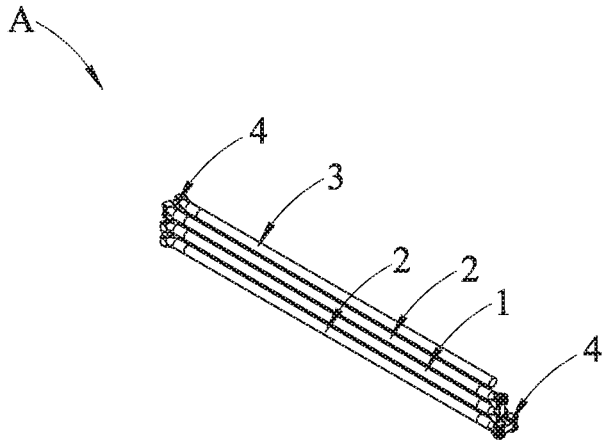
FIG. 8 is a perspective folded view of the hurdle structure.

In adjustment, when the first pivot member 41 and the second pivot member 42 are driven by an external force to rotate relative to each other, the projection 4321 of the positioning member 432 is detached from one of the grooves 4311 of the locking member 431 and is received in another one of the grooves 4311 of the locking member 431. Thus, the first pivot member 41 and the second pivot member 42 are rotated relative to each other to adjust the angle between each of the two upright poles 2 and each of the two support rods 3 as shown in FIG. 7 or to fold each of the two upright poles 2 and each of the two support rods 3 as shown in FIG. 8.

In the second preferred embodiment of the present invention, each of the hinge mechanisms 4 is also mounted between the transverse bar 1 and each of the two upright poles 2. Alternatively, the transverse bar 1 and each of the two upright poles 2 are formed integrally.

In the second preferred embodiment of the present invention, the projection 4321 of the positioning member 432 is a circular rod, and each of the grooves 4311 of the locking member 431 has a shape corresponding to that of the projection 4321, such that the projection 4321 of the positioning member 432 is locked and secured in one of the grooves 4311 of the locking member 431.

In the second preferred embodiment of the present invention, each of the grooves 4311 of the locking member 431 has two sides each provided with an arcuate face 4312 to guide movement of the projection 4321 of the positioning member 432 along each of the grooves 4311 of the locking member 431.

Figure 9:
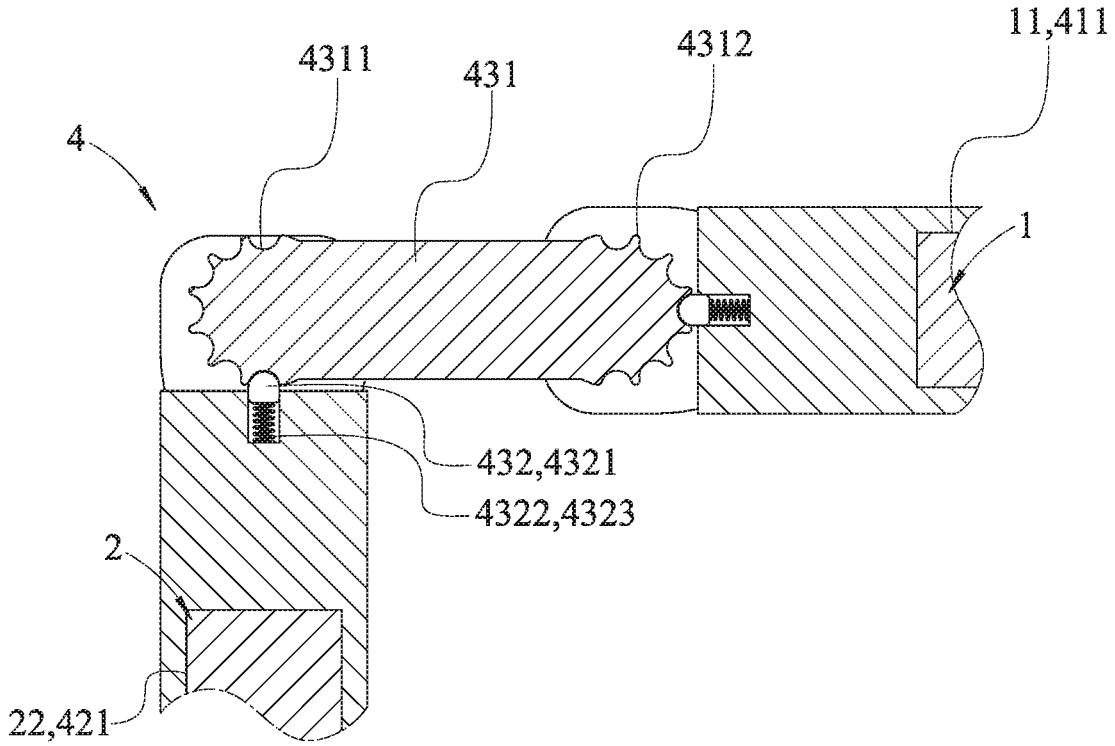
FIG. 9 is a locally enlarged cross-sectional view of the hurdle structure in accordance with a further preferred embodiment of the present invention.

Referring to FIG. 9 with reference to FIGS. 1-5, the positioning member 432 of each of the hinge mechanisms 4 is provided with a receiving recess 4323, and the projection 4321 of the positioning member 432 is mounted in the receiving recess 4323. The adjusting unit 43 of each of the hinge mechanisms 4 further includes an elastic member 4322 mounted in the receiving recess 4323 and biased on the projection 4321 of the positioning member 432, to push the projection 4321 of the positioning member 432 toward one of the grooves 4311 of the locking member 431.

Accordingly, the angle between the transverse bar 1 and each of the two upright poles 2 is adjustable, and the angle between each of the two upright poles 2 and each of the two support rods 3 is adjustable, such that the hurdle structure A has a height that can be adjusted according to the user's requirement, thereby facilitating the user operating the hurdle structure A. In addition, the user only needs to rotate the first pivot member 41 and the second pivot member 42 to adjust the angle between the transverse bar 1 and each of the two upright poles 2, and the angle between each of the two upright poles 2 and each of the two support rods 3, such that the height of the hurdle structure A is adjusted easily and conveniently, thereby facilitating the user adjusting the height of the hurdle structure A. Further, the hurdle structure A is folded as shown in FIG. 8, thereby facilitating packaging, storage and transportation of the hurdle structure A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A hurdle structure comprising:

a transverse bar, two upright poles, two support rods, and a plurality of hinge mechanisms;

wherein:

the transverse bar has two ends;

each of the two upright poles has an upper end;

each of the hinge mechanisms is mounted between the transverse bar and each of the two upright poles and includes a first pivot member, and a second pivot member pivotally connected with the first pivot member;

the first pivot member of each of the hinge mechanisms is provided with a first mounting portion secured on one of the two ends of the transverse bar;

the second pivot member of each of the hinge mechanisms is provided with a second mounting portion secured on the upper end of one of the two upright poles;

each of the hinge mechanisms further includes an adjusting unit mounted between the first pivot member and the second pivot member;

the adjusting unit of each of the hinge mechanisms includes a locking member and a positioning member;

the locking member of each of the hinge mechanisms is provided with a plurality of grooves;

the positioning member of each of the hinge mechanisms is provided with a projection positioned in one of the grooves of the locking member, such that each of the two upright poles is locked with the transverse bar, with a predetermined angle defined between each of the two upright poles and the transverse bar; and the first pivot member and the second pivot member are driven by an external force and are rotated relative to each other, and the projection of the positioning member is detached from one of the grooves of the locking member and is positioned in another one of the grooves of the locking member.

2. The hurdle structure of claim 1, wherein each of the hinge mechanisms is mounted between each of the two upright poles and each of the two support rods, and the first pivot member and the second pivot member are directly forced to rotate relative to each other when the projection of the positioning member is positioned in one of the grooves of the locking member.

3. The hurdle structure of claim 1, wherein the locking member is arranged above the positioning member, the grooves of the locking member are formed on a lower end of the first pivot member, the projection of the positioning member is formed on an upper end of the second pivot member, the projection of the positioning member is a semicircular rod, and each of the grooves of the locking member has a semicircular shape.

4. The hurdle structure of claim 1, wherein each of the grooves of the locking member has two sides each provided with an arcuate face, and the projection of the positioning member are situated between the arcuate faces of the two sides of one of the grooves.

5. The hurdle structure of claim 1, wherein the positioning member of each of the hinge mechanisms is provided with a receiving recess formed in an upper end of the second pivot member, the projection of the positioning member is mounted in the receiving recess, the projection of the positioning member is partially received in the receiving recess and partially received in one of the grooves of the locking member, and the adjusting unit of each of the hinge mechanisms further includes an elastic member mounted in the receiving recess and biased on the projection of the positioning member, to push the projection of the positioning member toward one of the grooves of the locking member.

6. A hurdle structure comprising:

a transverse bar, two upright poles, two support rods, and a plurality of hinge mechanisms;

wherein:

the transverse bar has two ends;

each of the two upright poles has a lower end;

each of the two support rods has an end portion;

each of the hinge mechanisms is mounted between each of the two upright poles and each of the two support rods and includes a first pivot member, and a second pivot member pivotally connected with the first pivot member;

the first pivot member of each of the hinge mechanisms is provided with a first mounting portion secured on the lower end of one of the two upright poles;

the second pivot member of each of the hinge mechanisms is provided with a second mounting portion secured on the end portion of one of the two support rods;

each of the hinge mechanisms further includes an adjusting unit mounted between the first pivot member and the second pivot member;

the adjusting unit of each of the hinge mechanisms includes a locking member and a positioning member;

the locking member of each of the hinge mechanisms is provided with a plurality of grooves;

the positioning member of each of the hinge mechanisms is provided with a projection positioned in one of the grooves of the locking member, such that each of the two upright poles is locked with each of the two support rods, with a predetermined angle defined between each of the two upright poles and each of the two support rods; and the first pivot member and the second pivot member are driven by an external force and are rotated relative to each other, and the projection of the positioning member is detached from one of the grooves of the locking member and is positioned in another one of the grooves of the locking member.

7. The hurdle structure of claim 6, wherein each of the hinge mechanisms is mounted between the transverse bar and each of the two upright poles, and the first pivot member and the second pivot member are directly forced to rotate relative to each other when the projection of the positioning member is positioned in one of the grooves of the locking member.

8. The hurdle structure of claim 6, wherein the locking member is arranged above the positioning member, the grooves of the locking member are formed on a lower end of the first pivot member, the projection of the positioning member is formed on an upper end of the second pivot member, the projection of the positioning member is a semicircular rod, and each of the grooves of the locking member has a semicircular shape.

9. The hurdle structure of claim 6, wherein each of the grooves of the locking member has two sides each provided with an arcuate face, and the projection of the positioning member are situated between the arcuate faces of the two sides of one of the grooves.

10. The hurdle structure of claim 6, wherein the positioning member of each of the hinge mechanisms is provided with a receiving recess formed in an upper end of the second pivot member, the projection of the positioning member is mounted in the receiving recess, the projection of the positioning member is partially received in the receiving recess and partially received in one of the grooves of the locking member, and the adjusting unit of each of the hinge mechanisms further includes an elastic member mounted in the receiving recess and biased on the projection of the positioning member, to push the projection of the positioning member toward one of the grooves of the locking member.

* * * * *